US008683756B2

(12) United States Patent
Schoetz

(10) Patent No.: US 8,683,756 B2
(45) Date of Patent: Apr. 1, 2014

(54) SCREW FOUNDATION SYSTEM WITH A CURABLE FILLING COMPOUND

(75) Inventor: Horst Schoetz, Irlbach (DE)

(73) Assignee: Krinner Innovation GmbH, Strasskirchen (DE)

( * ) Notice: Subject to any disclaimer, the term of this patent is extended or adjusted under 35 U.S.C. 154(b) by 217 days.

(21) Appl. No.: 13/059,026

(22) PCT Filed: Aug. 6, 2009

(86) PCT No.: PCT/EP2009/060205
§ 371 (c)(1),
(2), (4) Date: Mar. 1, 2011

(87) PCT Pub. No.: WO2010/018121
PCT Pub. Date: Feb. 18, 2010

(65) Prior Publication Data

US 2011/0138705 A1 Jun. 16, 2011

(30) Foreign Application Priority Data

Aug. 14, 2008 (DE) ..... 20 2008 010 913 U

(51) Int. Cl.
*E02D 5/80* (2006.01)

(52) U.S. Cl.
USPC ..... 52/157; 52/153; 52/298

(58) Field of Classification Search
USPC ..... 52/155–157, 165, 298, 704, 705, 153, 52/154; 256/65.14
See application file for complete search history.

(56) References Cited

U.S. PATENT DOCUMENTS

| | | | | |
|---|---|---|---|---|
| 4,707,964 | A | 11/1987 | Hoyt et al. | |
| 4,768,900 | A * | 9/1988 | Burland | 405/244 |
| 6,286,270 | B1 * | 9/2001 | Gruson et al. | 52/155 |
| 7,950,200 | B2 * | 5/2011 | Tropiano | 52/745.21 |
| 2008/0008555 | A1 * | 1/2008 | Ardern | 411/411 |

FOREIGN PATENT DOCUMENTS

| | | |
|---|---|---|
| DE | 94 09 252 | 9/1994 |
| DE | 101 46 140 | 4/2003 |
| DE | 10 2005 023465 | 1/2007 |

* cited by examiner

*Primary Examiner* — Charles A Fox
*Assistant Examiner* — Patrick Maestri
(74) *Attorney, Agent, or Firm* — Jordan and Hamburg LLP

(57) ABSTRACT

A screw foundation system for aligning and fastening a rod- or post-like object in the ground includes a sleeve-like plastic receiving part which can be screwed into the ground and which, in the fastened state, accommodates an end region of the rod- or post-like, object and surrounds their periphery of the object with a distance at least in certain portions; and a curable filling compound which, in the fastened state, fills the space between the end region of the rod- or post-like object and the inner contour of the receiving part, wherein the inner contour has undercuts for anchoring the cured filling compound. The screw foundation system can include a screwing-in tool having a dimensionally stable fitting core which can be inserted into the receiving part in order to screw in the latter.

11 Claims, 2 Drawing Sheets

SCREW FOUNDATION SYSTEM WITH A CURABLE FILLING COMPOUND

BACKGROUND OF THE INVENTION

The invention relates to a screw foundation system for aligning and fastening a rod- or post-like object in the ground according to a receiving part for such a screw foundation system.

Such screw foundation systems and the sleeve-like receiving parts which can be used therefor and which can be screwed into the ground are known in many forms.

They comprise the sleeve-like receiving part which can be screwed into the ground and which is mostly produced from plastic and which, in the fastened state, accommodates an end region of the rod- or post-like object and surrounds the periphery of said object with a distance at least in certain portions, and a granule-like filling compound (for example sand or grit) or else a curable filling compound, such as a polymer compound or concrete, which, in the fastened state, fills the space between the end region of the rod- or post-like object and the inner contour of the receiving part, and supports the end region of the rod- or post-like object in an alignable manner and—for example after the curing of the curable compound fixedly holds it.

The receiving part can be designed in its (outer and/or) inner contour cylindrically, conically, partly conically, or else as a polygon. The screwing-in tool or a fitting core provided thereon is then adapted to the inner contour in such a way that it can transmit the screwing-in forces to the receiving part by frictional engagement or preferably by form-fitting engagement. For this purpose, if appropriate a substantial or even a full-surface bearing of the fitting core on the inner contour of the associated receiving part can be provided. In the case of a round inner contour, in addition ribs on one part and corresponding grooves on the other part can support the force transmission. In the case of polygonal receiving parts, the corresponding shaping at the fitting core has a corresponding effect.

All these systems are designed in such a way that the rod- or post-like object can be well aligned during erection with the aid of the filling material provided (be it a granular or curable material) and then is fixedly held. This applies in particular also to curable materials, for instance concrete, which subsequently very reliably prevent positional changes of the anchored object.

SUMMARY OF THE INVENTION

However, it has been shown that the safeguard against pulling out in the case of extreme tensile loading counter to the screwing-in direction, in which case only curable filling compounds are used anyway as filling compound because granules afford insufficient resistance thereto, is sometimes insufficient and the cured filling compound detaches from the receiving part.

This results in the object of providing a simple and cost-effective safeguard against loosening of the filling compound for such particular loading scenarios.

This object is achieved according to the invention in that the inner contour of the receiving part has undercuts for anchoring the cured filling compound.

This is based on the finding that, in all conventional screw foundations, the anchoring of the filling compound against pulling out of the receiving part suffers from the fact that while the inner contour of the receiving parts is cylindrical, it usually opens conically counter to the screwing-in direction and so there is no form fit between the receiving part and the filling compound in the pulling-out direction. This shaping of the receiving part is justified by the fact that it should be relatively easy to pull the fitting core out of the receiving part again after the receiving part has been screwed into the ground. The result of this, however, is that the safeguard against the cured filling compound being pulled out of the receiving part can be insufficient because the unit consisting of receiving part and anchored object tends to loosen each time it is loaded. This is all the more true since the adhesion between the filling means and the material of the receiving part is very low under certain circumstances.

The undercuts can be formed in the inner contour of the receiving part or be integrally formed thereon. However, they should not be formed as outwardly continuous holes. This is because they could be clogged with earth as they are screwed in and would then miss their purpose.

The undercuts can be formed in an outwardly directed manner in the inner contour of the receiving part. This comes into consideration, for example when the fitting core bears more or less on the entire surface of the inner contour of the receiving part and fills the latter so that there is no room for the undercuts to be formed or integrally formed inwardly.

However, the undercuts can also be formed in an inwardly protruding manner in the inner contour or be integrally formed thereon. If the undercuts of the inner contour of the receiving part are formed or integrally formed in such a way that they protrude inwardly, it must be ensured, however, that they do not impair the function of the screwing-in tool. This risk occurs, for example, when the screw foundation system comprises a screwing-in tool with a dimensionally stable fitting core which can be inserted into the receiving part in order to screw into the latter and then bears in bearing regions on the inner contour of the receiving part and supports these bearing regions and, by means of form-fitting adaptation in certain regions when being introduced, transmits the forces and/or torques required for the introduction to the receiving part with a force path that is short relative to its length. In this case, it must be ensured that the undercuts are arranged outside the bearing regions on the inner contour.

Particular problems result here when the screw foundation system comprises a receiving part which, merely serving as encasing, is designed to be thin-walled in such a way that it obtains its dimensional stability required for screwing in only by means of the form-fitting bearing of the fitting core in certain regions. If the fitting core bears extensively on the inner contour here, undercuts which are possibly only in the form of outwardly directed formations can be provided in the inner contour of the receiving part.

These problems can be easily avoided in that a fitting core is provided for the screw foundation system and is formed for example from a plurality of webs which extend radially away in a star shape from the axis of the screwing-in tool over a length corresponding substantially to the length of the receiving part and which in their outer contour are adapted over their length substantially to the inner contour of the receiving part in such a way that, when inserted therein, they bear in their bearing regions substantially frictionally and/or in a form-fitting manner on the inner contour.

It has been shown, namely, that such bearing of the fitting core on certain regions is quite sufficient also in the case of thin-walled receiving parts in order to support the latter when screwing in and to transmit the screwing-in forces. In such a case, the intermediate spaces between the bearing regions of the fitting core on the receiving part afford sufficient space, however, for inwardly protruding undercuts to be integrally formed on the inner contour of the receiving part.

A further subject of the invention is the sleeve-like plastic receiving part which can be screwed into the ground for a screw foundation system, which receiving part has on its inner contour undercuts for anchoring the cured filling compound, wherein the undercuts should be arranged in particular outside the bearing regions of the fitting core of the screwing-in tool on the inner contour and on the surface of the receiving part can be formed as outwardly directed depressions or can be formed or integrally formed as inwardly directed elevations.

BRIEF DESCRIPTION OF THE DRAWINGS

The invention will now be described in more detail by means of exemplary embodiments in accordance with the drawings, in which.

DETAILED DESCRIPTION OF THE INVENTION

Figure 1:
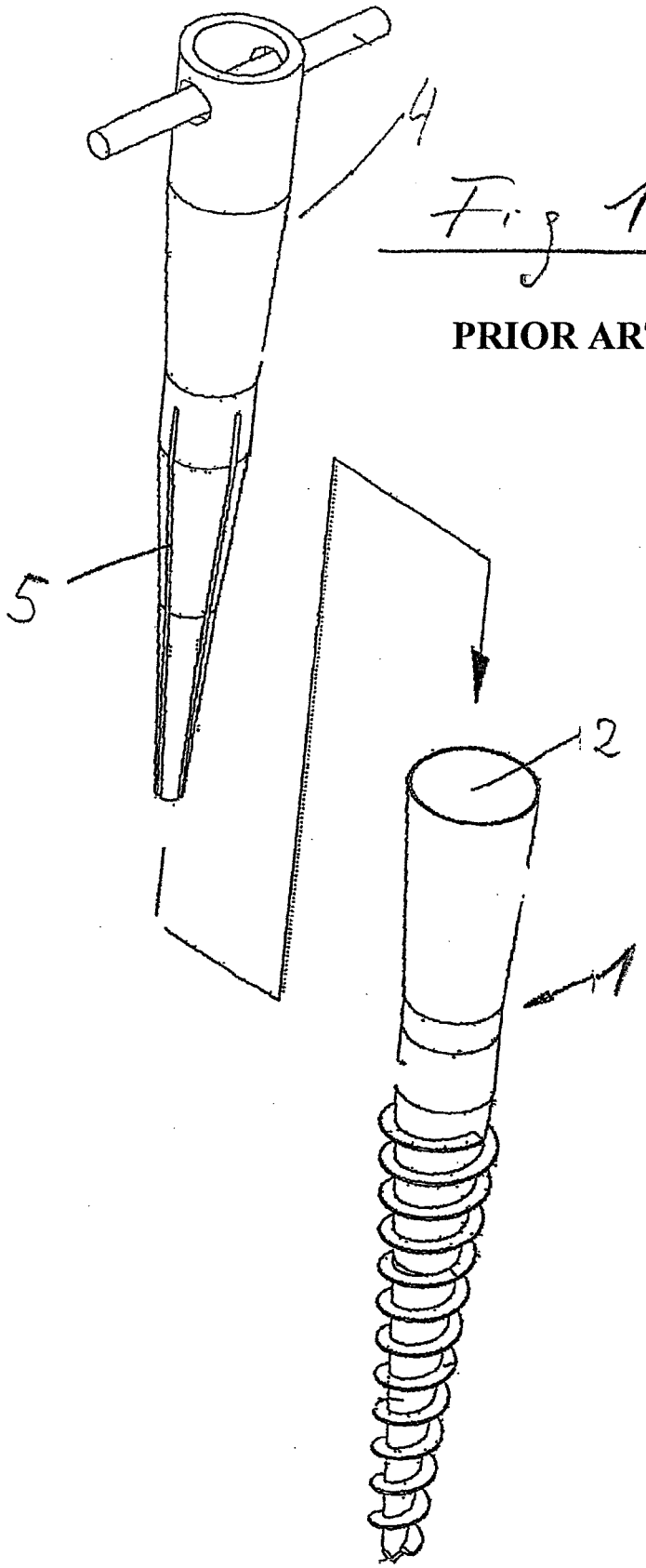
Fig 1 PRIOR ART
FIG. 1 shows a screwing-in tool (4) and a receiving part (1) of a screw foundation system according to the prior art, without undercuts according to the invention.

FIG. 1 shows a screwing-in tool (4) and a receiving part (1) of a screw foundation system according to the prior art, without undercuts (3) according to the invention. The receiving part (1) has an outer spiral in order to screw it in. The screwing-in tool (4) exhibits a fitting core (5), the outer contour of which corresponds substantially to the inner contour (2) of the receiving part (1) so that once it has been inserted into the receiving part (1) it bears extensively on the inner contour (2) thereof. Space for the undercuts according to the invention is available here only in the form of outwardly directed formations (not shown) in the inner contour (2) of the receiving part (1).

Figure 2:
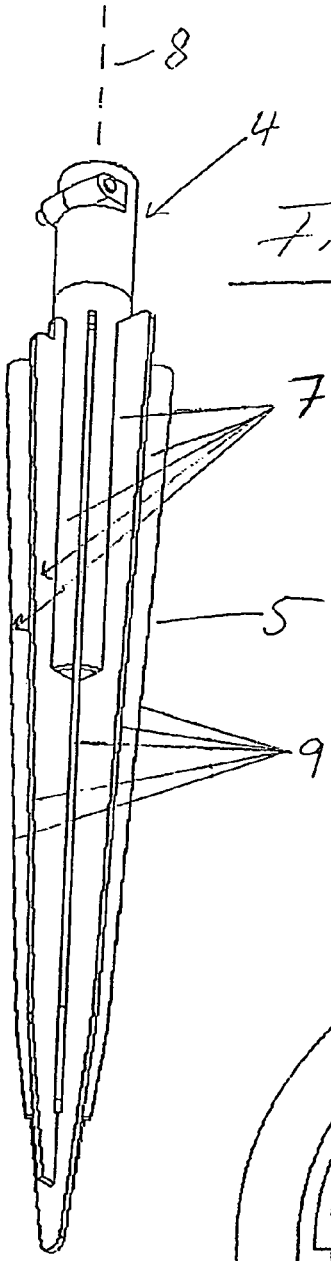
FIG. 2 shows a different screwing-in tool (4)

FIG. 2 shows a different screwing-in tool (4) having a dimensionally stable fitting core (5) formed by webs (7) that extent radially away from the axis (8) of the screwing-in tool (4) in the manner of a star and have outer contours (9) which are provided for bearing on correspondingly formed bearing regions (6) of the inner contour (2) of the associated receiving part (1).

Figure 3:
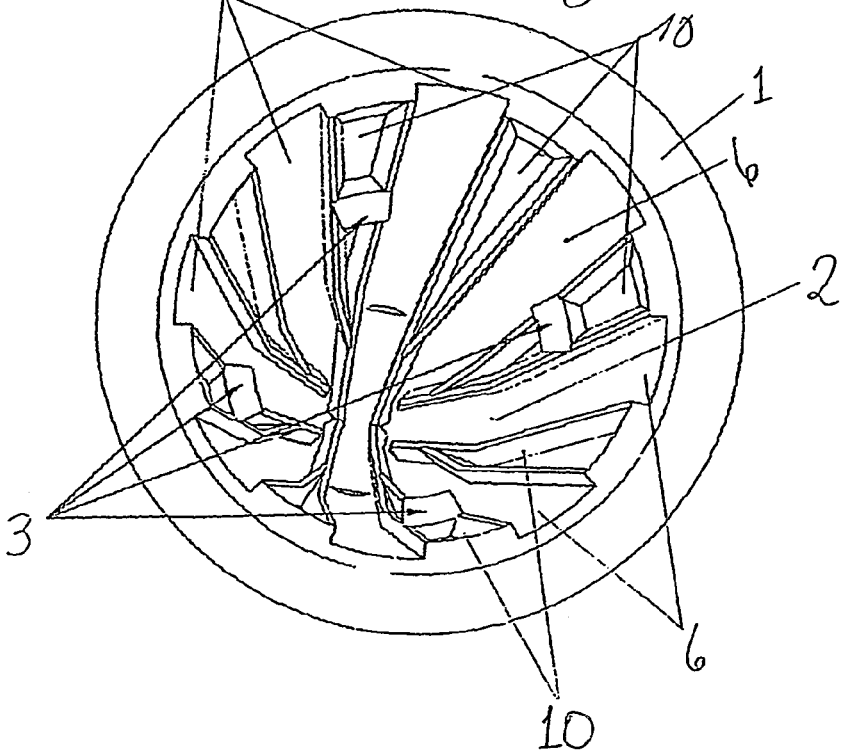
FIG. 3 shows a perspective plan view of the inner contour (2) of a receiving part (1) according to the invention.

FIG. 3 shows a perspective plan view of the inner contour (2) of a receiving tool (1) according to the invention that fits the screwing-in tool (4) according to FIG. 2. The bearing regions (6) for the outer contour (9) of the webs (7) to bear on are shown. Formed between the bearing regions are spacing regions (10), in which there is space for fitting undercuts (3). In this case, the spacing regions (10)—as shown here—can be delimited from the bearing regions (6) by inwardly formed or integrally formed ribs, wherein the ribs can then at the same time be acted on by the webs as drivers when the receiving part is screwed in and out.

The invention claimed is:

1. A screw foundation system for aligning and fastening in the ground an object substantially in the form of a rod or a post, comprising:

a plastic receiving part substantially in the form of a sleeve, having bearing regions on an inner contour of the sleeve and which is configured to be screwed into the ground and which, in the fastened state, accommodates an end region of the rod- or post-like object and surrounds the periphery of said object with spaces at least in certain portions;

a curable filling substance which, in the fastened state of the object, is cured and fills the spaces between the end region of the rod- or post-like object and the inner contour of the receiving part;

wherein the inner contour has undercuts located in spacing regions adjacent to the bearing regions, the undercuts having an inward surface arranged to fit into intermediate spaces between the bearing regions of the plastic receiving part, the undercuts being arranged for anchoring the cured filling substance; and a screwing-in tool which comprises a dimensionally stable fitting core which can be inserted into the receiving part in order to screw the receiving part into the ground and then bears on the bearing regions on the inner contour of the receiving part and transmits forces and/or torques applied to the tool to the receiving part thereby to screw the receiving part into the ground.

2. The screw foundation system as claimed in claim 1, wherein the receiving part sleeve provides a boundary for containing the curable filling substance and has a wall thickness incapable of bearing the screwing-in forces and/or torques from the screwing-in tool in regions other than the bearing regions.

3. The screw foundation system as claimed in claim 2, wherein the fitting core comprises a plurality of webs which extend radially away in a star shape from an axis of the screwing-in tool over a length corresponding substantially to the length of the receiving part and having an outer contour substantially conforming to the inner contour of the receiving part so as to engage the bearing regions on the inner contour of the receiving part thereby to effect said transmitting of said forces and/or torques.

4. A plastic receiving part for a screw foundation system for aligning and fastening in the ground an object substantially in the form of a rod or a post, the screw foundation system comprising the receiving part, a curable filling substance for filling spaces between an end of the object and an inner contour of the receiving part and a tool for engaging the receiving part to transmit to the receiving part forces and/or torques applied to the tool thereby to screw the receiving part into the ground;

the plastic receiving part comprising a sleeve; and wherein the sleeve has an outer contour configured for being screwed into the ground; and wherein the sleeve has an inner contour including: bearing regions configured for receiving the part forces and/or torques applied to the screwing-in tool; spacing regions adjacent to the bearing regions and defining intermediate spaces between the bearing regions; and undercuts, situated within the intermediate spaces, configured for anchoring the cured filling substance.

5. The plastic receiving part of claim 4, wherein the undercuts have an inward surface arranged to fit into said intermediate spaces between the bearing regions of the plastic receiving part.

6. The plastic receiving part of claim 4, wherein the undercuts comprise outwardly extending depressions in the inner contour.

7. The plastic receiving part of claim 4, wherein the undercuts comprise inwardly extending projections integral with inner contour.

8. A screw foundation system for aligning and fastening in the ground an object substantially in the form of a rod or a post, comprising:

a plastic receiving part substantially in the form of a sleeve, having bearing regions on an inner contour of the sleeve and which is configured to be screwed into the ground and which, in the fastened state, accommodates an end region of the rod- or post-like object and surrounds the periphery of said object with spaces at least in certain portions;

a curable filling substance which, in the fastened state of the object, is cured and fills the spaces between the end region of the rod- or post-like object and the inner contour of the receiving part;

wherein the inner contour has undercuts located circumferentially adjacent to the bearing regions within spacing regions, the spacing regions extending radially outward so as to be more radially outward than an adjacent inward surface portion of the adjacent bearing regions, the undercuts being arranged for anchoring the cured filling substance; and a screwing-in tool which comprises a dimensionally stable fitting core which can be inserted into the receiving part in order to screw the receiving part into the ground and then bears on the bearing regions on the inner contour of the receiving part and transmits forces and/or torques applied to the tool to the receiving part thereby to screw the receiving part into the ground.

9. The screw foundation system as claimed in claim 3, wherein the plurality of webs have an outer contour substantially conforming to the spacing regions at the inner contour of the receiving part.

10. The plastic receiving part of claim 4, wherein the sleeve has a longitudinal axis, wherein the outer contour is configured with a spiral for allowing the plastic receiving part to be screwed into the ground, and wherein first bearing regions among said inner contour bearing regions have a first length portion located longitudinally along a same length as at least a portion of said spiral.

11. A plastic receiving part for a screw foundation system for aligning and fastening in the ground an object substantially in the form of a rod or a post, the screw foundation system comprising the receiving part, a curable filling substance for filling spaces between an end region of the object and an inner contour of the receiving part and a tool for engaging the receiving part to transmit to the receiving part forces and/or torques applied to the tool thereby to screw the receiving part into the ground;

the plastic receiving part having a sleeve configuration;

wherein the sleeve configuration has an outer contour with a spiral configured for allowing the plastic receiving part to be screwed into the ground along said spiral;

wherein the sleeve has an inner contour including: bearing regions configured for receiving the part forces and/or torques applied to the screwing-in tool, and undercuts configured for anchoring the cured filling substance in a manner that deters against the cured filling substance being pulled out of the plastic receiving part; and wherein a first bearing region, among said inner contour bearing regions, has a first length portion located longitudinally along a same length portion of the sleeve configuration as at least a portion of said outer contour spiral.

* * * * *